United States Patent [19]

Wilks

[11] 4,124,836

[45] Nov. 7, 1978

[54] ELECTRIC FUSE

[75] Inventor: Howard G. Wilks, Newbury, Mass.

[73] Assignee: Gould Inc., Rolling Meadows, Ill.

[21] Appl. No.: 793,514

[22] Filed: May 4, 1977

[51] Int. Cl.[2] ..... H01H 85/02

[52] U.S. Cl. ..... 337/186; 337/282; 337/414

[58] Field of Search ..... 337/186, 280, 282, 158, 337/159, 160, 161, 162, 414, 415

[56] References Cited

U.S. PATENT DOCUMENTS 3,979,709 9/1976 Healey, Jr. ..... 337/186

FOREIGN PATENT DOCUMENTS 430,095 6/1935 United Kingdom ..... 337/280

*Primary Examiner*—Harold Broome
*Attorney, Agent, or Firm*—Erwin Salzer

[57] ABSTRACT

An electric fuse including a fusible element, a filler in which said element is embedded, a pair of electroconductive terminal elements arranged at the ends of said fusible element and conductively interconnected by said fusible element. The fuse further includes a tubular casing supporting said pair of terminal elements on the ends thereof. Said casing consists of a plurality of stripes of a glass fiber material rolled to cylindrical shape overlapping along the longitudinal edges thereof and impregnated with a polyester resin. The innermost surface of said casing is lined with Johns-Manville "Quintex II".

2 Claims, 4 Drawing Figures

ELECTRIC FUSE

BACKGROUND OF THE INVENTION

U.S. Pat. No. 3,979,709, Sept. 7, 1976 to Daniel P. Healey, Jr. relates to an electric fuse whose casing is manufactured by the so-called pultrusion process. by using that process as described in the above patent tubular casings may be obtained which have a great dynamic strength, i.e. a great strength to resist impulse loads as occurring in fuses, particularly current-limiting fuses, and which comply - so it seemed - with all other requirements of tubular fuse casings, or fuse tubes. It was, however, discovered that the mass consisting of glass fibers and cured polyester, of which pultruded tubing of the aforementioned kind is made, has a larger heat-transmitting conductivity than conventional fuse tube materials, such as, for instance, vulcanized fiber or convolutely rolled glass-cloth melamine. When using the tube material described by Healy U.S. Pat. No. 3,979,709, in order to obtain the same current rating as in an existing fuse, all fusible elements had to be redesigned or re-rated, or the wall tubing had to be given a thickness exceeding mechanical strength requirements. None of these solutions is economically acceptable.

It is well known to line fuse tubes with a layer of asbestos where a reduction of the radially outward heat flow from the fusible element, or elements, is desired. But asbestos is a carcinogen, i.e. a cancer-causing substance, and was ruled out for this reason from the very outset.

This invention is the outgrowth of a systematic investigation of materials which are non-carcinogenous, and are capable - though in form of thin lining sheets - to impart to pultruded glass cloth polyester tubings as described in Healey U.S. Pat. No. 3,979,709 about the same thermal conductivity as conventional fuse tube materials, e.g. glass-cloth-melamine laminates.

The product which meets the above requirements is a tough, paperlike product including highly purified asbestos in non-carcigenous form, and other insulation materials manufactured and sold by Johns-Manville under the trademark "QUINTEX II".

SUMMARY OF THE INVENTION

A fuse embodying this invention includes a fusible element, an arc-extinguishing filler embedding said fusible element, and a pair of electro-conductive terminal elements arranged at the ends of said fusible element and conductively interconnected by said fusible element.

A tubular casing or fuse tube supports said pair of terminal elements on the ends thereof. Said casing consists of a plurality of stripes of glass fiber material overlapping along the longitudinal edges thereof and impregnated with a polyester resin. A lining of Johns-Manville "QUINTEX II" is arranged inside said casing.

DESCRIPTION OF PREFERRED EMBODIMENT

Figure 1:
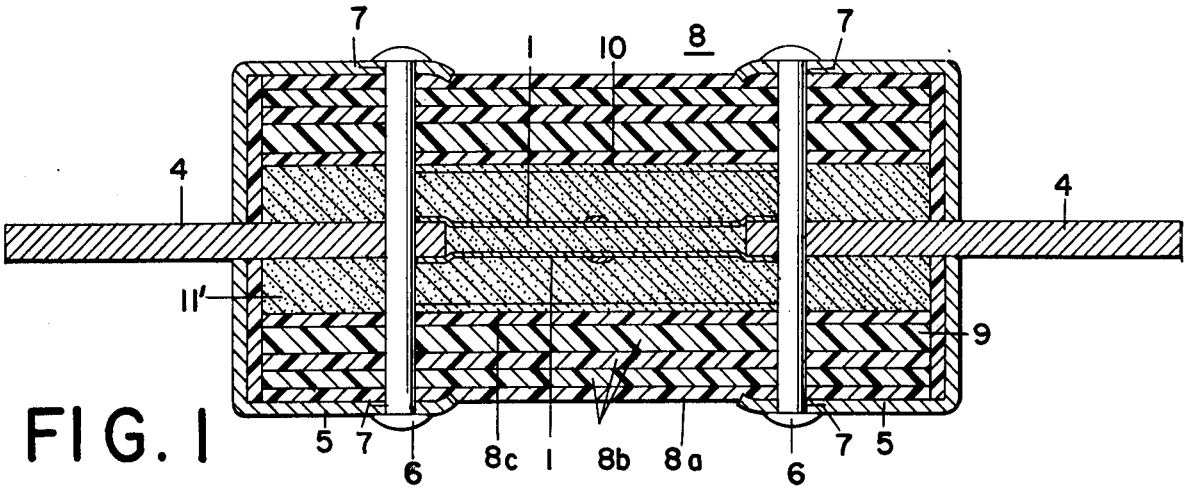
FIGS. 1 and 2 are substantially longitudinal sections along the casing of the fuse taken at 90°.
Figure 2:
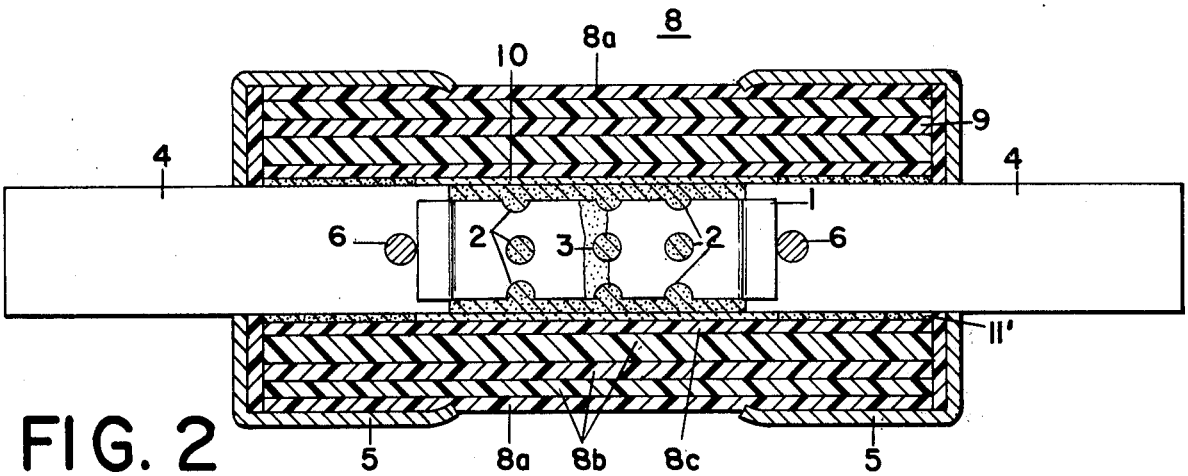

Referring now to the drawings, reference character 1 has been applied to indicate a pair of fusible elements of sheet copper or sheet silver. Elements 1 are provided with circular perforations 2 which indicate the points of arc-inception at major fault currents. Elements 1 are provided with a low fusing point overlay 3, e.g. of tin, for severing fusible elements 1 on occurrence of overloads of inadmissible duration. The axially outer ends of fusible elements 1 are conductively connected to a pair of terminal elements in form of blade contacts 4. The latter project through the end surfaces of a pair of caps or ferrules 5. Blade contacts 4 are supported by ferrules 5 and by a pair of pins 6 which project transversely through blade contacts 4. The ends of pins 6 are fitted into bores 7 provided in tubular casing or fuse tube 8. In FIGS. 1 and 2 fuse tube 8 has been shown as consisting of but three layers, namely the radially outermost layer **8*a* of woven fiber glass, an intermediate layer 8*b* of fiber mat and the innermost layer 8*c* of woven fiber glass cloth. FIGS. 1 and 2 represent casing 1 in but diagrammatic fashion. For a more detailed description of fuse tube or casing 8 reference may be had to FIGS. 3 and 4 of the drawings and the context thereof. Layers 8*a* and 8*c* are formed of heavy strips of woven glass cloth. These strips are arranged so that the direction of their longitudinal edges is the same as the direction of the axis of casing 8. Each of layers 8*a* and 8*c* overlaps in the region of their longitudinal edges. The overlaps of layers 8*a* and 8*b* are angularly displaced, i.e. the overlaps of layer 8*a* may be situated at 0° and the overlaps of layer 8*c* may be situated at 180° Woven glass cloth is a relatively strong material having a high content of glass per unit while non-woven fiber mat is a mechanically relatively weak material being rather fluffy and having a relatively small fiber content per unit. Therefore, in spite of the overlaps formed by layers 8*a* and 8*c* which cause a local increase of numbers of layers and of the fiber density at the regions of overlap, the the give of the layer 8*b* allows to absorb the locally increased number and density of layers 8*a*,8*c* so that the wall thickness of casing 8 is substantially uniform along the entire periphery thereof. It is only the proportion of glass fibers to impregnating polyester 9 that changes from point to point of tubing 8**, without having a significant effect on its dynamic strength.

Inside of casing 8 is a lining 10 of the Johns-Manville product known by its trademark "QUINTEX II". The liner of "QUINTEX II" may be held very thin, hardly thicker than an ordinary piece of paper, and yet its thermal insulating capacity is sufficient to impart to the fuse casing substantially the same thermal properties as, e.g. a casing of glass-cloth-melamine has. The minimal bulk of "QUINTEX II" allows filling of the casing 8 with a substantially equal amount of pulverulent arc-quenching filler or quartz sand 11', which was not possible heretofore in instances where asbestos was used to line a fuse tube because of the relatively larger bulk of asbestos.

Figure 3:
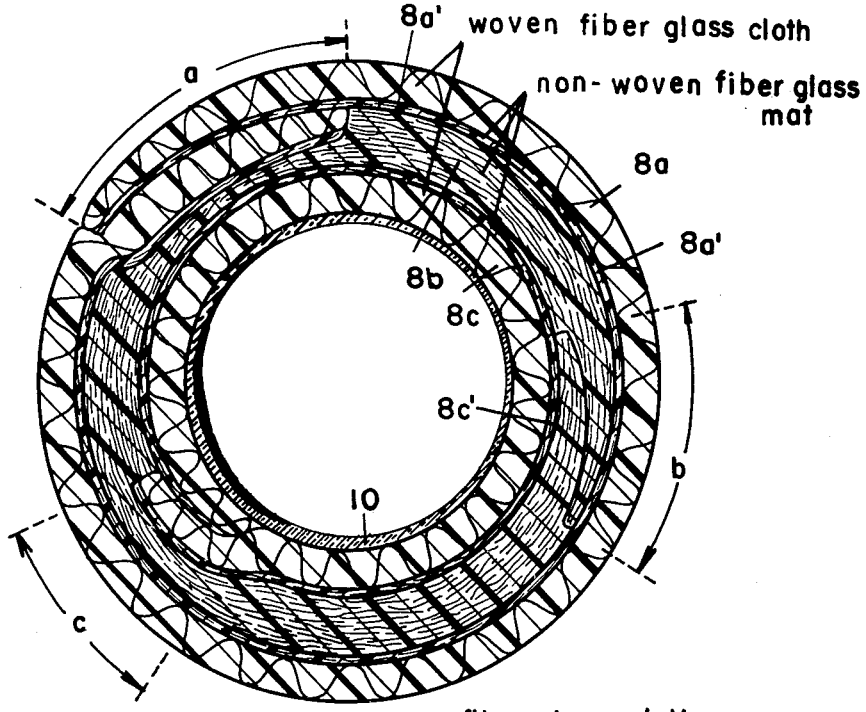
FIGS. 3 and 4 are substantially transverse sections across the casing of the fuse and deleting the arc-quenching filler of the fuse and the fusible element thereof.
Figure 4:
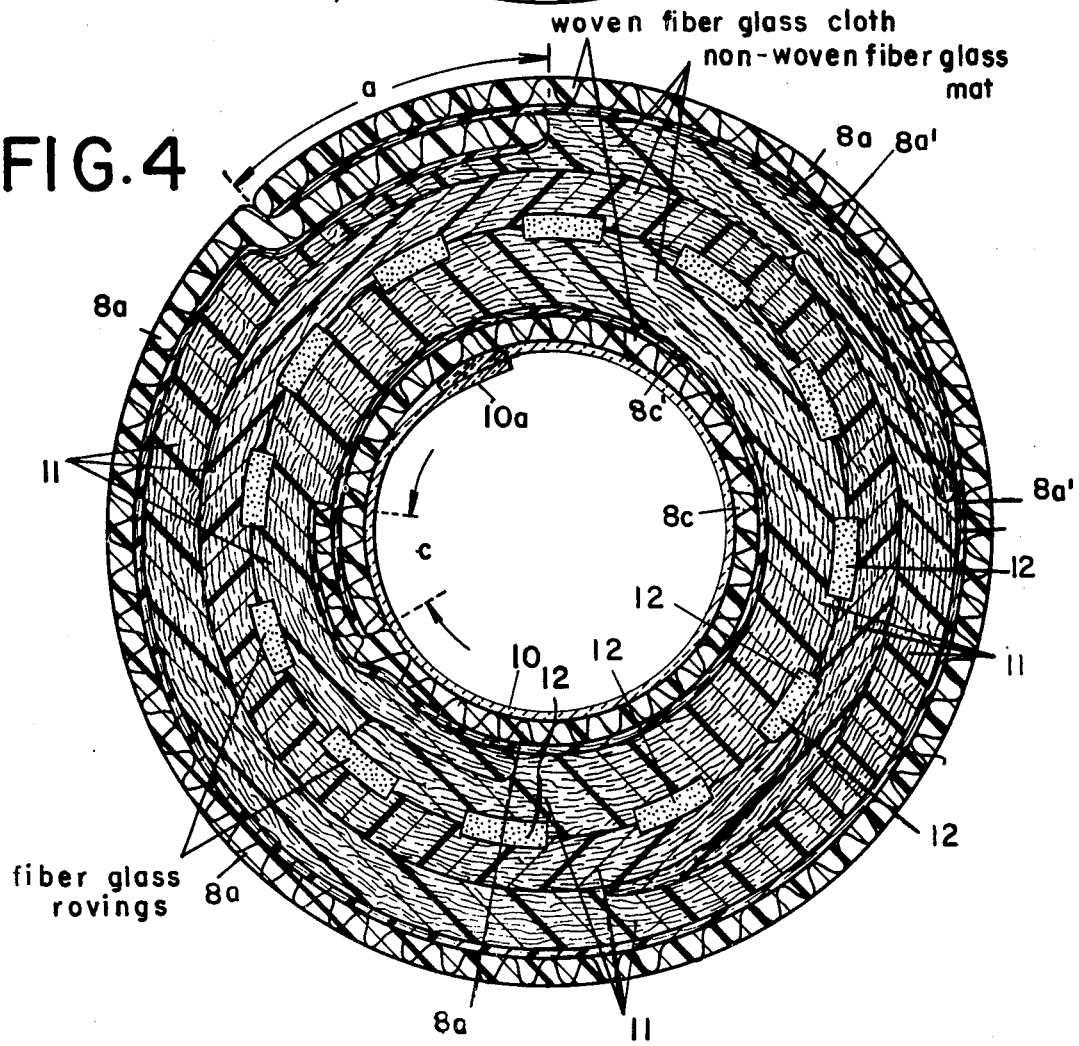

Referring now to FIGS. 3 and 4 of the drawing, reference character **8*a* has been applied to indicate the outermost layer of woven fiber cloth overlapping at the region a, reference character 8*b*** has been applied to indicate a layer of fiber mat overlapping at the region *b* and reference numeral **8*c*** has been applied to indicate the innermost layer of woven fiber glass gloth overlapping at the region *c*. Layers **8*a* and 8*c* are provided with a coextensive lining layer 8***a*′ and 8*c*′ of glass fiber matte. These lining layers 8*a*′ and 8*c*′ allow to decrease the thickness of intermediate layer 8*b*, and in some cases to entirely eliminate the intermediate layer 8*b*. Reference numeral 10 has been applied to indicate the lining of "QUINTEX II".

In FIG. 4 the same reference characters as in FIG. 3 have been applied to designate like parts. Thus 8*a* is the outermost layer of woven fiber glass overlapping at *a*, 8*c* is the innermost layer of woven fiber glass overlapping at *c* and 10 is the lining of Johns-Manville "QUINTEX II" overlapping at 10*a*. FIG. 4 further shows layers 8*a*′ and 8*c*′ coextensive and integral with layers 8*a* and 8*c* formed by non-woven fiber glass mat. Between layers 8*a* and 8*c* a number of layers of non-woven fiber mat are arranged which have been designated by the common reference numeral 11. Layers 11 consist of non-woven mat material, the longitudinal edges of which overlap. A further layer 12 consisting of fiber glass rovings is arranged between layers 11. Rovings 12 are arranged to provide the necessary strength to the tubular composite when drawn through a pultrusion machine. The number of layers 11 may be decreased, and in some instances even made zero, in the presence of lining layers 8*a*′ and 8*c*′. Also the layer of fiber glass rovings 12 may be dispensed with. The innermost layer 10 of Johns-Manville "QUINTEX II" must be present unless it is permissible to increase the heat transfer and thus to change the rating of the fuse.

For the sake of greater clarity the arc-quenching filler inside of the casing 8 of the fuse and the fusible element have not been shown in FIGS. 3 and 4.

The layer of Johns-Manville "QUINTEX II" has a very smooth surface and is likely to be displaced in a direction longitudinally of the casing of the fuse during assembly thereof. This is prevented by the knife-blade-supporting pins 6 forming abutments for lining layer 10 precluding any significant movement thereof in a direction longitudinally of the casing of the fuse.

I claim as my invention:

1. An electric fuse comprising (a) a fusible element;

(b) an arc-quenching filler in which said fusible element is embedded;

(c) a pair of electroconductive terminal elements arranged at the ends of said fusible element and conductively interconnected by said fusible element;

(d) a tubular casing supporting said pair of terminal elements on the ends thereof, said casing comprising a plurality of stripes of a glass-fiber material overlapping along the longitudinal edges thereof and impregnated with polyester resin; and (e) a lining comprising highly purified asbestos in noncarcigenous form and other insulation materials on the radially inner surface of said casing, said lining decreasing the thermal conductivity of said casing to such an extent as to be of the same order as that of a casing of vulcanized fiber or convolutely wound glass-cloth melamine, and said liner being the product known by the trademark "QUINTEX II" formerly of Johns-Manville and presently of the Quin-T-Corporation.

2. An electric fuse as specified in claim 1 having a fusible element conductively connected to a pair of blade contacts supported by a pair of pins projecting transversely through said pair of blade contacts wherein said lining is positioned inside said casing by said pair of pins.

* * * * *